United States Patent [19]

Hall

[11] 3,983,835

[45] Oct. 5, 1976

[54] GAS PRESSURIZED HYDRAULIC MARINE PROPULSION TILTING SYSTEM WITH AUTOMATIC LET-DOWN ASSEMBLY

[75] Inventor: Charles B. Hall, Ingleside, Ill.

[73] Assignee: Outboard Marine Corporation, Waukegan, Ill.

[22] Filed: Apr. 24, 1975

[21] Appl. No.: 571,078

[52] U.S. Cl. ..... 115/41 HT
[51] Int. Cl.[2] ..... B63H 5/12
[58] Field of Search ..... 115/41 HT, 41 R; 267/126, 120; 114/150; 91/4 R, 5

[56] References Cited

UNITED STATES PATENTS

| | | | |
|---|---|---|---|
| 3,143,338 | 8/1964 | Hoard | 267/126 |
| 3,177,837 | 4/1965 | Sherrill | 114/66.5 P |
| 3,527,452 | 9/1970 | Hausenblas et al. | 267/126 |
| 3,863,592 | 2/1975 | Borst | 115/41 HT |

*Primary Examiner*—Stephen G. Kunin
*Assistant Examiner*—Gregory W. O'Connor
*Attorney, Agent, or Firm*—Michael, Best & Friedrich

[57] ABSTRACT

Disclosed herein is a marine propulsion device including a member adapted to be attached to a boat hull, a propulsion assembly pivotally connected to the member for vertical swinging movement, a hydraulic cylinder-piston assembly connected between the member and the propulsion assembly and including a cylinder having opposed first and second ends, a first sealed reservoir adapted to contain pressure fluid, a valve for introducing pressurized gas into the reservoir, a second sealed reservoir, a pressure relief valve communicating with the second reservoir, and a control valve structure comprising first, second, and third valves having a common actuator movable between first, second and third positions, which first valve communicates between the first end of the cylinder and the first reservoir and is open when the actuator is in the first position and is closed when the actuator is in the second and third positions, which second valve communicates between the first reservoir and the first end of the cylinder and is open when the actuator is in the third position and is closed when the actuator is in the first and second positions, which third valve communicates between the second end of the cylinder and the second reservoir and is open when the actuator is in the first position and is closed when the actuator is in the second and third positions. Also included is a let-down valve assembly which communicates with the second reservoir and with a fourth valve which forms a part of the control valve structure and which is open when the actuator is in the second position and which is closed when the actuator is in the first and third positions. Also included is a conduit extending between the first and second reservoirs and including a spring biased valve permitting flow from the first reservoir to the second reservoir and preventing flow from the second reservoir to the first reservoir.

21 Claims, 2 Drawing Figures

GAS PRESSURIZED HYDRAULIC MARINE PROPULSION TILTING SYSTEM WITH AUTOMATIC LET-DOWN ASSEMBLY

RELATED APPLICATION

Attention is directed to my co-pending application Ser. No. 571,077, filed Apr. 24, 1975, which application is incorporated herein be reference.

BACKGROUND OF THE INVENTION

The invention relates generally to marine propulsion devices such as outboard motors and stern drive units.

The invention also relates to arrangements for tilting and trimming the proplusion assemblies of such marine propulsion devices.

The invention further relates to hydraulically operated trimming and tilting arrangements for the propulsion assemblies of such marine propulsion devices.

Attention is directed to the following prior U.S. Patents:

Carpenter 3,733,455 issued Mar. 27, 1973;
Shimanckas 3,847,108 issued Nov. 12, 1974;
Borst 3,863,592 issued Feb. 4, 1975.

Attention is also directed to the following prior United States Patent Applications:

Ser. No. 320,913 filed June 4, 1973, now U.S. Pat. No. 3,885,517;
Ser. No. 339,587 filed Dec. 18, 1972, now U.S. Pat. No. 3,863,592.

SUMMARY OF THE INVENTION

The invention provides a marine propulsion device including a member adapted to be attached to a boat hull, a propulsion assembly pivotally connected to the member for vertical swinging movement when the member is attached to the boat hull, a hydraulic cylinder-piston assembly connected between the member and the propulsion assembly and including a cylinder having opposed first and second ends, a first sealed reservoir adapted to contain pressure fluid, means for introducing pressurized gas into the first reservoir, a second sealed reservoir, a pressure relief valve communicating with the second reservoir, and a control valve structure comprising first, second, and third valves having a common actuator movable between first, second, and third positions, which first valve communicates between the first end of the cylinder and the first reservoir and is open when the actuator is in the first position and is closed when the actuator is in the second and third positions, which second valve communicates between the first reservoir and the first end of the cylinder and is open when the actuator is in the third position and is closed when the actuator is in the first and second positions, which third valve communicates between the second end of the cylinder and the second reservoir and is open when the actuator is in the first position and is closed when the actuator is in the second and third positions.

In accordance with an embodiment of the invention, the marine propulsion device includes a let-down valve assembly communicating with the second reservoir and the control valve structure further includes a fourth valve which communicates between the first end of the cylinder and the let-down valve assembly and which is open when the actuator is in the second position and which is closed when the actuator is in the first and third positions.

In one embodiment in accordance with the invention, the marine propulsion device further includes a one-way valve located between the first valve and the first reservoir and permitting flow from the first reservoir to the first valve while preventing flow from the first valve to the first reservoir.

In one embodiment in accordance with the invention, the marine propulsion device further includes a one-way valve located between the third valve and the second reservoir and permitting flow from the third valve to the second reservoir while preventing flow from the second reservoir to the third valve.

In one embodiment in accordance with the invention, the marine propulsion device further includes a stand pipe extending upwardly in the first reservoir and communicating with the first reservoir above the bottom thereof, and a conduit communicating between the stand pipe and the second reservoir and including therein a one-way valve permitting flow from the first reservoir to the second reservoir and preventing flow from the second reservoir to the first reservoir.

The invention also provides a marine propulsion device including a member adapted to be attached to a boat hull, a propulsion assembly pivotally connected to the member for vertical swinging movement, a hydraulic cylinder-piston assembly connected between the member and the propulsion assembly and including a cylinder having opposed ends, a sealed reservoir adapted to contain a quantity of pressure fluid, means for introducing pressure gas into the reservoir, conduit means communicating between the reservoir and one of the ends of the cylinder, the valve means in the conduit means for selectively opening and closing the conduit means so as to control pressure fluid flow between the one end of the cylinder and the reservoir.

The invention also provides a marine propulsion device including a member adapted to be attached to a boat hull, a propulsion assembly pivotally connected to the member for vertical swinging movement relative to the member when the member is attached to the boat hull, a hydraulic cylinder-piston assembly connected between the member and the propulsion assembly and including a cylinder having opposed ends, a sealed reservoir including a lower part containing pressure fluid and an upper part containing pressurized gas, a pressure relief valve communication with the upper part of the reservoir, conduit means communicating between the lower part of the reservoir and one of the ends of the cylinder, and valve means in the conduit means for selectively opening and closing the conduit means so as to control pressure fluid flow between the one end of the cylinder and the reservoir.

In accordance with an embodiment of the invention, the conduit means between the reservoir and the one end of the cylinder includes a one-way valve located between the valve means and the reservoir and permitting flow from the reservoir to the valve means while preventing flow from the valve means to the reservoir.

The invention also provides a marine propulsion device including a member adapted to be attached to a boat hull, a propulsion assembly pivotally connected to the member for vertical swinging movement, a hydraulic cylinder-piston assembly connected between the member and the propulsion assembly and including a cylinder having opposed ends, a first sealed reservoir including a lower part adapted to contain pressure fluid, means for introducing pressure gas into the first reservoir, a second sealed reservoir including a lower part adapted to contain pressure fluid, a pressure relief valve communicating with the second reservoir, first conduit means communicating between the first reservoir and one of the ends of the cylinder, second conduit means communicating between the second reservoir and the other of the cylinder ends, first valve means in the first conduit means for selectively opening and closing the first conduit means so as to control pressure fluid flow between the one end of the cylinder and the first reservoir, second valve means in the second conduit means for selectively opening and closing the second conduit means so as to control pressure fluid flow between the other end of the cylinder and the second reservoir, and means including a common actuator for co-ordinating operation of the first and second valve means.

The invention also provides a marine propulsion device including a member adapted to be attached to a boat hull, a propulsion assembly pivotally connected to the member for vertical swinging movement, a hydraulic cylinder-piston assembly connected between the member and the propulsion assembly and including a cylinder having opposed ends, a first sealed reservoir having a bottom and adapted to contain pressure fluid, a stand pipe extending upwardly in the first reservoir and communicating with the first reservoir above the bottom, means for introducing pressurized gas into the first reservoir, first valve controlled conduit means communicating between one of the ends of the cylinder and the first reservoir, a second sealed reservoir having an upper part, a pressure relief valve communicating with the upper part of the second reservoir, second valved controlled conduit means communicating between the other of the ends of the cylinder and the second reservoir, and a conduit communicating between the stand pipe and the second reservoir and including therein a one-way valve permitting flow from the first reservoir to the second reservoir and preventing flow from the second reservoir to the first reservoir.

One of the principal features of the invention is the provision of a gas pressurized and selectively operable hydraulic system for assisting in raising and lowering a propulsion assembly.

Another of the principal features of the invention is the provision of a marine propulsion device which includes a gas pressurized hydraulic system for assisting in raising and lowering a propulsion assembly, which hydraulic system includes provision for affording automatic let down of a propulsion assembly after striking of an underwater obstacle.

Other features and advantages of the embodiments of the invention will become apparent from the following general description, claims, and appended drawings.

THE DRAWINGS

Figure 1:
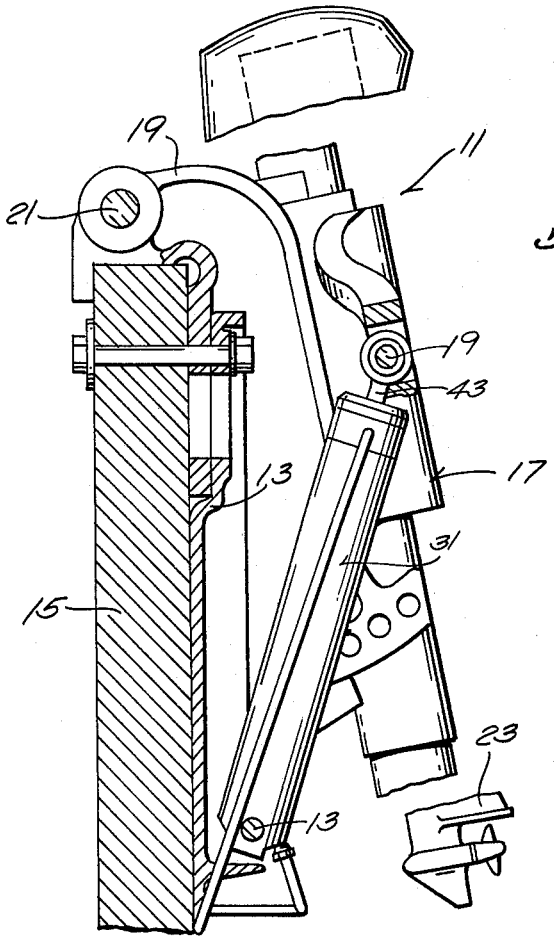
FIG. 1 is a partially schematic side-elevation view, partially in section, of a marine propulsion device incorporating various of the features of the invention.

Before explaining the embodiments of the invention in detail, it is to be understood that the invention is not limited in its application to the details of construction and the arrangement of the components set forth in the following description or illustrated in the drawings. The invention is capable of other embodiments and of being practiced and carried out in various ways. Also it is to be understood that the phraseology and terminology employed herein is for purpose of description and should not be regarded as limiting.

GENERAL DESCRIPTION

Shown in the drawings is a marine propulsion device which is shown schematically in the form of an outboard motor 11 including a member 13 adapted to be suitably attached to a boat hull 15, and a propulsion assembly 17 connected to the member 13 for vertical swinging movement between a fully lowered position and a fully raised position when the member 13 is connected to the boat hull 15. Any suitable form of propulsion assembly can be employed, including, for instance, a swivel bracket 19 connected to the member 13 about a horizontal tilt pin 21 and a propulsion unit 23 connected to the swivel bracket 19 for steering movement relative thereto. The invention is equally applicable to stern drive units and to outboard motors.

Figure 2:
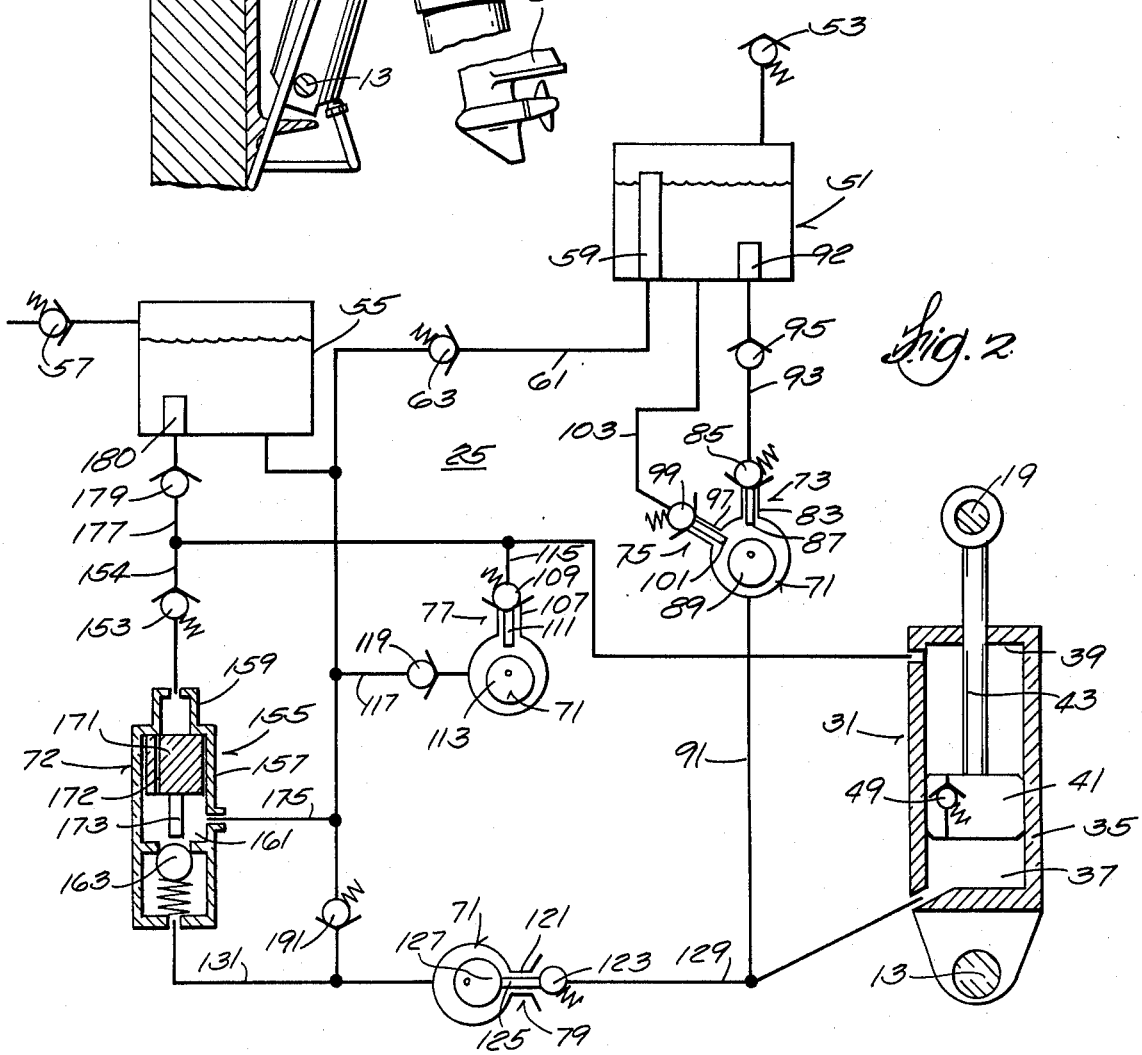
FIG. 2 is a schematic diagram of the hydraulic system incorporated in the marine propulsion device shown in FIG. 1.

Connected between the member 13 and the propulsion assembly 17 is (See FIG. 2) a gas pressurized hydraulic system 25 for variably locating the propulsion assembly 17 relative to the boat mounted member 13 between a fully lowered position and a fully elevated or raised position.

The system 25 includes one or more hydraulic cylinder-piston assemblies 31 which are connected between the member and the propulsion assembly. More particularly, the cylinder-piston assembly 31 comprises a cylinder 35 which has opposed first and second ends 37 and 39, respectively, which, at its first end 37, is pivotally connected to one of the member 13 and the propulsion assembly 17, and which contains a piston 41 connected to a piston rod 43 which extends through the second cylinder end 39 and is pivotally connected to the other of the member 13 and the propulsion assembly 17. Preferably, the cylinder-piston assembly 31 is connected between the member 13 and the swivel bracket 19 and the first end 37 of the cylinder 35 is pivotally connected to the member 13 and the piston rod 43 is pivotally connected to the swivel bracket 19.

Located in the piston 41 is a one-way valve 49 which is in the form of a spring biased ball check valve and which prevents flow from the first end 37 of the cylinder 35 to the second end 39, but which permits flow from the second end 39 of the cylinder 35 to the first end 37 of the cylinder 35 so that, in the event the propulsion assembly 17 impacts as underwater obstacle and the cylinder 35 accordingly extends rapidly, the valve 49 will accommodate flow from the second end 39 of the cylinder 35 through the piston 41 to the first end 37 of the cylinder 35. The bias on the valve 49 is relatively high, for instance, about 2500 lbs./sq. in.

The system 25 also includes a first or relatively high pressure, fluid reservoir 51 comprising a lower part adapted to contain a quantity of hydraulic fluid and an upper part which communicates with suitable means for introducing pressurized gas, such as air, into the fluid reservoir 51. Such gas introducing means includes a normally closed inlet valve 53 which is in the form of a spring biased one-way valve and which is operative to prevent flow from the reservoir and to permit flow into the reservoir when the pressure of the entering gas is above a predetermined level determined by the spring.

The system 25 also includes a second or relatively low pressure fluid reservoir 55 including a lower part adapted to contain a quantity of hydraulic fluid, and an upper part communicating with a suitable normally closed relief valve 57 which is in the form of a spring biased one-way valve permitting outflow from the second reservoir when the pressure therein is above a predetermined level and preventing inflow into the second reservoir. The bias on the valve 57 is relatively low, as for instance, about 15 to 20 lbs./sq. in. Accordingly, the pressure in the reservoir 55 will be relatively low.

Means are also provided in the system 25 for connecting the reservoirs 51 and 55 to each other to allow fluid flow from the first or high pressure reservoir 51 to the second or low pressure reservoir 55 when the pressure in the first reservoir 51 rises above a predetermined level. More specifically, the first reservoir 51 includes a stand pipe 59 which extends upwardly therein and communicates adjacent the top thereof with the interior of the first reservoir 51. At its bottom, the stand pipe communicates with a conduit 61 which also communicates with the bottom of the second reservoir 55 and which includes a normally closed valve 63 which is in the form of a spring biased one-way valve and which permits flow from the first reservoir to the second reservoir while preventing flow from the second reservoir to the first reservoir. The bias of the valve 63 controls the pressure in the first reservoir and preferably is moderately high, for instance, between about 50 to 300 lbs/sq. in., depending upon the weight of the propulsion assembly. The stand pipe 59 serves to drain excess fluid or gas from the first reservoir 51 to the second reservoir 55 and to relieve the first reservoir 51 of excess pressure.

Also included in the system 25 is a valve structure (not completely shown) which includes an actuator movable between first, second, and third positions corresponding respectively to "tilt-up", "run", and "tilt-down". While other arrangements are possible, in the illustrated construction, the actuator 71 is mounted for rotary movement between the first, second and third positions. In addition, th system 25 includes a let-down valve assembly 72 which affords return of the propulsion assembly 17 to its lower position after the striking of an underwater obstacle.

More specifically, the valve structure includes first, second, and third valves 73, 75, and 77 respectively, which selectively control fluid communication between the hydraulic cylinder-piston assembly 31 and the reservoirs 51 and 55 and a fourth valve 79 which communicates between the hydraulic cylinder-piston assembly 31 and the let-down valve assembly 72. The first valve 73 controls flow from the first reservoir 51 to the first end 37 of the cylinder 35 and comprises a port 83 relative to which a spring biased ball-like valve member 85 is operable to normally close the port 83. Extending from the valve member 85 is a part or stud 87 which is engagable by an eccentric portion 89 of the actuator 71 so as to open the valve 73 when the actuator 71 is in the first or tilt-up position and so as to permit closure of the valve 73 by its spring bias when the actuator 71 is in the second or "run" position and in the third or tilt-down position. The first valve 73 communicates with the first end 37 of the cylinder 35 through a fluid conduit 91 and communicates with a filter 92 at the bottom of the first reservoir 51 through a conduit 93 including a one-way valve 95 which permits flow from the first reservoir 51 to the first valve 73 and which prevents flow from the first valve 73 to the first reservoir 51 and thereby prevents flow from the end 37 of the cylinder 35 to the first reservoir 51, thereby preventing let-down when the actuator 71 is in the first or run position.

The second valve 75 controls fluid flow from the first end 37 of the cylinder 35 to the first reservoir 51 and includes a port 97 relative to which a spring biased ball-like valve member 99 is operable to normally close the port 97. Extending from the valve member 99 is a part or stud 101 which is engageable by the eccentric portion 89 of the actuator 71 so as to open the valve 75 when the actuator 71 is in the third or tilt-down position and so as to permit closure of the valve 75 under its spring bias when the actuator is in the first or tilt-up position and in the second or run position.

The second valve 75 communicates with the first end 37 of the cylinder 35 through the conduit 91 in common with the first valve 73 and communicates with the first reservoir 51 through a conduit 103 which opens directly into the bottom of the first reservoir 51. If desired, the second valve 75 could communicate with the first end 37 of the cylinder 35 through a conduit separate from the conduit 91 and could be operated by an eccentric portion other than the portion 89. However, the illustrated construction is preferred for economic reasons.

The third valve 77 controls flow from the second end 39 of the cylinder 35 to the second reservoir 55 and includes a port 107 relative to which a spring biased ball-like valve member 109 is operable to normally close the port 107. Extending from the valve member 109 is a part or stand stud 111 which is engagable by an eccentric portion 113 of the actuator so as to open the valve 77 when the actuator 71 is in the first or tilt-up position and so as to permit closure of the valve 77 by its spring bias when the actuator 71 is in the second or run position and in the third or tilt-down position.

The third valve 77 communicates with the second end 39 of the cylinder 35 through a conduit 115 and communicates with the second reservoir 55 through a conduit 117 which includes a one-way valve 119 permitting flow from the third valve 77 to the second reservoir 55 and preventing flow from the second reservoir 55 to the third valve 77.

The fourth valve 79 controls fluid flow from the first end 37 of the cylinder 35 to the let-down valve assembly 72 and includes a port 121 relative to which a spring-biased ball-like valve member 123 is movable to normally close the port 121. Extending from the valve member 123 is a part or stud 125 which is engagable by an eccentric portion 127 of the actuator 71 to open the valve 79 when the actuator 71 is in the second or run position and to permit closure of the valve 79 by its spring bias when the actuator 71 is in the first or tilt-up position or in the third or tilt-down position. The fourth valve 79 is connected to the first end 37 of the cylinder 35 by a conduit 129 and is connected to the let-down valve assembly 72 by a conduit 131.

The let-down valve assembly 72 affords automatic transfer of hydraulic fluid from the first end 37 of the cylinder 35 to the second end 39 of the cylinder 35 in order to accommodate let-down of the propulsion assembly 17 after the striking of an underwater obstacle. More particularly, the automatic let-down valve assembly 72 is hydraulicly connected between the ends 37 and 39 of the cylinder 35 and includes a normally closed valve 153 which is in the form of a spring biased check valve, and which communicates through a conduit 154 with the second end 39 of the cylinder 35 and is arranged to prevent flow to the second end 39 of the cylinder 35 and to releasably prevent or permit flow from the second end 39 of the cylinder 35 therethrough. The bias on the valve 153 is relatively high, for instance, approximately 2,500 lbs./sq. in.

Also included in the let-down valve assembly 72 is a let-down valve 155 including a housing 157 having a first end 159 communicating with the valve 153 and a second end 161 communicating with another normally closed valve 163 which is in the form of a spring biased check valve and which, in turn, communicates with the conduit 131. The bias on the valve 163 is relatively low, for instance about 25 lbs./sq. in.

Located within the let-down valve housing 159 is a let-down piston 171 which is movable between a first position adjacent to the first end 159 of the let-down valve housing 157 and a second position spaced from the first postion in the direction toward the second end 161 of the let-down valve housing 157. The let-down piston 171 includes a restricted orifice or slot 172 which communicates between the first and second ends of the let-down valve housing 157. In addition, the let-down piston 171 also includes a projection 173 which is operable, upon movement of the piston 171 to the second position, to open the valve 163 so as to permit fluid flow from the first end 37 of the tilt cylinder 35 into the let-down valve housing 157.

Communicating between the second end of the let-down valve housing 157 and the second end 39 of the cylinder 35 is conduit means including a conduit 175 extending from adjacent the second end 161 of the let-down valve housing 157 to the second reservoir 55, and a conduit 177 extending from the second reservoir 55 to the second end 39 of the cylinder 35 and including a one-way valve 179 preventing flow to the second reservoir 55 and permitting flow from the second reservoir 55.

The system 25 can also include a normally closed over-load valve 191 which communicates between the conduits 131 and 175 and which is in the form of a spring biased, check valve arranged so as to permit flow from the conduit 131 to the conduit 175 and to prevent flow from the conduit 175 to the conduit 131 and hence from the first end 37 of the cylinder 35 to the second reservoir 55 in the event excess thrust is developed during operation of the propulsion assembly 17. If desired, the valve 191 can be omitted.

When the actuator 71 is in the first or tilt-up position and the reservoirs 51 and 55 are pressurized by gas to the level determined by the relief valves 57 and 63, the pressure fluid in the first reservoir 55 communicates through the first valve 73 with the first end 37 of the cylinder 35 so as to increase the force acting thereon. At the same time, the second end 37 of the cylinder 35 communicates through the third valve 77 and through the valve 119 with the second reservoir 55 so that the fluid displaced from the second end 37 of the cylinder 35 by the upward movement of the propulsion assembly 17 flows to the second reservoir 55. As already pointed out, the check valve 95 between the first valve 73 and the first reservoir 51 prevents contraction of the hydraulic cylinder-piston assembly 31 and thereby prevents down tilting of the propulsion assembly. When the actuator 71 is in the first or tilt-up position, the second and fourth valves 75 and 79 are closed.

Depending upon the pressure level of the gas in the reservoirs 51 and 55, the pressure on the fluid can serve either to swing the propulsion assembly 17 upwardly toward its fully raised position or to substantially reduce the amount of manual force required to effect upward tilting of the propulsion assembly 17.

When the actuator 71 is in the second or run position, the first, second, and third valves 73, 75 and 77 are closed and the fourth valve 79 is open to permit communication between the first end 37 of the cylinder 35 and the let-down assembly 72. At the same time, the let-down assembly 72 also communicates with the second end 39 of the cylinder 35 through the conduit 154, subject to the normally closed condition of the one-way valve 153.

When the actuator 71 is in the third or tilt-down position, the first, third, and fourth valves 73, 77 and 79 are closed and the second valve 75 is open to permit fluid flow from the first end 37 of the cylinder 35 to the first reservoir 51 upon contraction of the cylinder-piston assembly 31 accompanying lowering of the propulsion assembly 17. As the cylinder-piston assembly 31 contracts, fluid is drawn into the second end 39 of the cylinder 35 through the conduit 177 and check valve 179 and through the filter 180 from the second reservoir 55 so as to maintain the second end 39 of the cylinder 35 occupied with fluid. Depending upon the pressures in the reservoirs 51 and 55, the propulsion assembly 17 will either descend slowly toward its lower position against the pressure in the reservoir 51 or manual force may be required to assist in lowering the propulsion assembly 17.

In the event the propulsion assembly 17 strikes an underwater obstacle when the actuator is in the second or run position, sudden upward movement of the propulsion assembly 17 will cause extension of the cylinder 35 and consequent immediate relatively high pressurization of the fluid adjacent to the second end 39 of the cylinder 35. Under such circumstances, the pressure fluid flows past the piston 41 through the valve 49 from the second end 39 to the first end 37 of the cylinder 35 so as to permit such extension. During the period when the second end 39 of the cylinder 35 is highly pressurized, such pressurization will be imparted through the conduit 154 to open the valve 153 so as to permit passage of a relatively small amount of highly pressurized fluid therethrough to the first end 159 of the let-down valve housing 157, which fluid is effective to displace the let-down piston 171 from the first position to the second position. Upon full extension of the tilt cylinder 35, the pressure condition at the second end 39 thereof will be relieved and the valve 153 will again close preventing return of the pressure fluid at the first end 159 of the let-down valve housing 157 through the valve 153 to the second end 39 of the cylinder 35, thereby temporarily retaining the let-down valve piston 171 in the second position so as thereby to retain the valve 163 open.

Upon reaching the fully raised position, the propulsion assembly 17 will tend to return downwardly either because of impacting at the fully raised position or simply because of the weight of the motor. Temporary maintenance of the open condition of the valve 163 by the let-down valve piston 171 permits contraction of the cylinder 35 accompanying lowering of the propulsion assembly 17. In this regard, contraction of the cylinder 35 causes outflow of fluid from the first end 37 thereof, which outflow travels through the conduit 131, through the valve 163 into the second end 161 of the let-down valve housing 157 and through the conduit 175 back to the second reservoir 55. At the same time, the expanding space at the second end 39 of the cylinder 35 draws fluid from the second reservoir 55 through the filter 180, and through the conduit 177 including the one-way valve 179 to the second end 39 of the cylinder 35 to maintain the second end 39 of the cylinder 35 fully occupied with hydraulic fluid.

Referring to the pressurized fluid trapped at the first end 159 of the let-down valve housing 157, such fluid gradually flows through the restricted orifice or slot 172 to the second end 161 of the let-down valve housing 157 and then through the conduit 175 to the second reservoir 55. Such travel of the trapped fluid past the let-down valve piston 171 causes return movement of the let-down piston 171 toward the first end 159 of the let-down valve housing 157 under the influence of the spring biasing the valve 163 to the closed position, thereby eventually again permitting closure of valve 163 after completion of fluid flow from the first end 37 of the cylinder 35 to the second reservoir 55. Thus, after striking an underwater obstacle, the propulsion assembly will return to its fully lowered position and thereafter may be trimmed as desired by operation of the valve structure.

Various of the features of the invention are set forth in the following claims.

What is claimed is:

1. A marine propulsion device including a member adapted to be attached to a boat hull, a propulsion assembly pivotally connected to said member for vertical swinging movement, a hydraulic cylinder-piston assembly connected between said member and said propulsion assembly and including a cylinder having opposed first and second ends, a first sealed reservoir adapted to contain pressure fluid, means for introducing pressurized gas into said first reservoir, a second sealed reservoir, and a control valve structure comprising first, second, and third valves having a common actuator movable between first, second and third positions, said first valve communicating between said first end of said cylinder and said first reservoir and being open when said actuator is in said first position and being closed when said actuator is in said second and third positions, said second valve communicating between said first reservoir and said first end of said cylinder and being open when said actuator is in said third position and being closed when said actuator is in said first and second positions, said third valve communicating between said second end of said cylinder and said second reservoir and being open when said actuator is in said first position and being closed when said actuator is in said second and third positions.

2. A marine propulsion assembly in accordance with claim 1 and further including conduit means communicating between said second reservoir and said second end of said cylinder and including a one-way valve permitting fluid flow from said second reservoir to said second end of said cylinder and preventing fluid flow from said second end of said cylinder to said second reservoir.

3. A marine propulsion device in accordance with claim 1 and further including a let-down valve assembly communicating with said second reservoir and wherein said control valve structure further includes a fourth valve which communicates between said first end of said cylinder and said let-down valve assembly and which is open when said actuator is in said second position and which is closed when said actuator is in said first and third positions.

4. A marine propulsion device in accordance with claim 3 wherein said let-down valve assembly comprises a fifth valve communicating with said second end of said cylinder and biased to releasably prevent fluid flow therethrough from said second end of said cylinder, a sixth valve communicating with said first end of said cylinder and biased to releasably prevent fluid flow therethrough from said first end of said cylinder, a let-down valve having a first end communicating with said fifth valve and a second end communicating with said sixth valve, a piston reciprocable in said let-down valve between a first position adjacent to said first end of said let-down valve and a second position spaced from said first position in the direction away from said first end of said let-down valve, means on said piston operable when said piston is in said second position to open said sixth valve against the bias thereof, conduit means affording fluid flow to said second end of said cylinder from adjacent said second end of said let-down valve, and bypass means affording restricted fluid flow from one side of said piston to the other, whereby application of pressure fluid to said first end of said let-down valve from said fifth valve displaces said piston from said first position to said second position to open said sixth valve so as to permit fluid flow from said first end of said cylinder through said sixth valve, through a part of said let-down valve, and through said conduit means to said second end of said cylinder and whereby said piston will return from said second position to said first position in response to fluid flow through said restricted bypass means from said first end to said second end of said let-down valve.

5. A marine propulsion assembly in accordance with claim 4 wherein said conduit means includes a one-way valve permitting fluid flow from said let-down valve to said second end of said cylinder and preventing fluid flow from said second end of said cylinder to said let-down valve.

6. A marine propulsion assembly in accordance with claim 5 wherein said second reservoir is located in said conduit means between said one-way valve and said let-down valve.

7. A marine propulsion device in accordance with claim 1 and further including a one-way valve located between said first valve and said first reservoir and permitting flow from said first reservoir to said first valve while preventing flow from said first valve to said first reservoir.

8. A marine propulsion device in accordance with claim 1 and further including a one-way valve located between said third valve and said second reservoir and permitting flow from said third valve to said second reservoir while preventing flow from said second reservoir to said third valve.

9. A marine propulsion device in accordance with claim 1 and further including a stand pipe extending upwardly in said first reservoir and communicating with said first reservoir above the bottom thereof, and a conduit communicating between said stand pipe and said second reservoir and including therein a one-way valve permitting flow from said first reservoir to said second reservoir and preventing flow from said second reservoir to said first reservoir.

10. A marine propulsion device in accordance with claim 9 wherein said one-way valve is spring biased so as to relieve pressure in said first reservoir above a predetermined level.

11. A marine propulsion device including a member adapted to be attached to a boat hull, a propulsion assembly pivotally connected to said member for vertical swinging movement, a hydraulic cylinder-piston assembly connected between said member and said propulsion assembly and including a cylinder having opposed ends, a sealed reservoir adapted to contain a quantity of pressure fluid, means for introducing pressure gas into said reservoir, conduit means extending exteriorly of said cylinder and communicating between said reservoir and one of said ends of said cylinder, and valve means in said conduit means for selectively opening and closing said conduit means so as to control pressure fluid flow between said one end of said cylinder and said reservoir.

12. A marine propulsion device in accordance with claim 11 and further including a one-way valve located in said conduit means between said valve means and said reservoir and preventing flow from said valve means to said reservoir while permitting flow from said reservoir to said valve means.

13. A marine propulsion device in accordance with claim 11 wherein said valve means includes first and second valves and wherein said conduit means comprises a first conduit between said valve means and said one end of said cylinder, a second conduit extending between said first valve and said reservoir and including a one-way valve preventing flow from said first valve to said reservoir while permitting flow from said reservoir to said first valve, and a third conduit extending between said second valve and said reservoir.

14. A marine propulsion device including a member adapted to be attached to a boat hull, a propulsion assembly pivotally connected to said member for vertical swinging movement relative to said member, a hydraulic cylinder-piston assembly connected between said member and said propulsion assembly and including a cylinder having opposed ends, a sealed reservoir including a lower part containing pressure fluid and an upper part containing pressurized gas, a pressure relief valve communicating with the upper part of said reservoir, conduit means extending exteriorly of said cylinder and communicating between said lower part of said reservoir and one of said ends of said cylinder, and valve means in said conduit means for selectively opening and closing said conduit means so as to control pressure fluid flow between said one end of said cylinder and said reservoir.

15. A marine propulsion device in accordance with claim 14 and further including a one-way valve located in said conduit means between said valve means and said reservoir and permitting flow from said reservoir to said valve means while preventing flow from said valve means to said reservoir.

16. A marine propulsion device including a member adapted to be attached to a boat hull, a propulsion assembly pivotally connected to said member for vertical swinging movement, a hydraulic cylinder-piston assembly connected between said member and said propulsion assembly and including a cylinder having opposed ends, a first sealed reservoir including a lower part adapted to contain pressure fluid, means for introducing pressure gas into said first reservoir, a second sealed reservoir including a lower part adapted to contain pressure fluid, a pressure relief valve communicating with said second reservoir, first conduit means communicating between said first reservoir and one of said ends of said cylinder, second conduit means communicating between said second reservoir and the other of said cylinder ends, first valve means in said first conduit means for selectively opening and closing said first conduit means so as to control pressure fluid flow between said one end of said cylinder and said first reservoir, second valve means in said conduit means for selectively opening and closing said second conduit means so as to control pressure fluid flow between said other end of said cylinder and said second reservoir, and means including a common actuator for coordinating operation of said first and second valve means.

17. A marine propulsion device in accordance with claim 16 and further including a stand pipe extending upwardly in said first reservoir and communicating with said first reservoir above the bottom thereof, and a conduit communicating between said stand pipe and said second reservoir and including therein a one-way valve permitting flow from said first reservoir to said second reservoir and preventing flow from said second reservoir to said first reservoir.

18. A marine propulsion device in accordance with claim 17 wherein said one-way valve is spring biased so as to relieve pressure in said first reservoir above a predetermined level.

19. A marine propulsion device in accordance with claim 16 and further including let-down means affording passage of fluid from said one end of said cylinder to said other end of said cylinder so as to permit contraction of said cylinder-piston assembly enabling let-down of said propulsion assembly after impacting an underwater obstacle.

20. A marine propulsion device in accordance with claim 19 wherein said let-down means comprises a first valve communicating with said other end of said cylinder and biased to releasably prevent fluid flow therethrough from said other end of said cylinder, a second valve communicating with said one end of said cylinder and biased to releasably prevent fluid flow therethrough from said one end of said cylinder, a let-down valve having a first end communicating with said first valve and a second end communicating with said second valve, a piston reciprocable in said let-down valve between a first position adjacent to said first end of said let-down valve and a second position spaced from said first position in the direction away from said first end of said let-down valve, means on said piston operable when said piston is in said second position to open said second valve against the bias thereof, conduit means affording fluid flow to said other end of said cylinder from adjacent said second end of said let-down valve, and bypass means affording restricted fluid flow from one side of said piston to the other, whereby application of pressure fluid to said first end of said let-down valve from said first valve displaces said piston from said first position to said second position to open said second valve so as to permit fluid flow from said one end of said cylinder through said second valve, through a part of said let-down valve, and through said conduit means to said other end of said cylinder, and whereby said piston will return from said second position to said first position in response to fluid flow through said restricted bypass means from said first end to said second end of said let-down valve.

21. A marine propulsion device including a member adapted to be attached to a boat hull, a propulsion assembly pivotally connected to said member for vertical swinging movement, a hydraulic cylinder-piston assembly connected between said member and said propulsion assembly and including a cylinder having opposed ends, a first sealed reservoir having a bottom and adapted to contain pressure fluid, a stand pipe extending upwardly in said first reservoir and communicating with said first reservoir above said bottom, means for introducing pressurized gas into said first reservoir, first valve controlled conduit means communicating between one of said ends of said cylinder and said first reservoir, a second sealed reservoir having an upper part, a pressure relief valve communicating with said upper part of said second reservoir, second valve controlled conduit means communicating between the other of said ends of said cylinder and said second reservoir, and a conduit communicating between said stand pipe and said second reservoir and including therein a biased one-way valve permitting flow from said first reservoir to said second reservoir and preventing flow from said second reservoir to said first reservoir.

* * * * *